US009480285B2

(12) United States Patent
Liu

(10) Patent No.: US 9,480,285 B2
(45) Date of Patent: Nov. 1, 2016

(54) ELECTRONIC CIGARETTE AND ITS ATOMIZING DEVICE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 789 days.

(21) Appl. No.: 13/824,987

(22) PCT Filed: Nov. 13, 2012

(86) PCT No.: PCT/CN2012/084504
§ 371 (c)(1),
(2) Date: Mar. 18, 2013

(87) PCT Pub. No.: WO2014/075209
PCT Pub. Date: May 22, 2014

(65) Prior Publication Data
US 2014/0130796 A1 May 15, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2013/0037041 A1* 2/2013 Worm et al. ..... A24F 47/008 131/329
2013/0213419 A1* 8/2013 Tucker et al. ..... A24F 47/008 131/328
2014/0123989 A1* 5/2014 LaMothe et al. ..... A24F 47/008 131/328
2014/0360517 A1* 12/2014 Taggart et al. ..... A24F 47/008 131/329

FOREIGN PATENT DOCUMENTS

CN 101843368 * 9/2010

OTHER PUBLICATIONS

CN 101843368 (English Abstract), Chen, Sep. 2010.*

* cited by examiner

*Primary Examiner* — Michael H Wilson
*Assistant Examiner* — Dionne W Mayes
(74) *Attorney, Agent, or Firm* — Cheng-Ju Chiang

(57) ABSTRACT

The present invention discloses an electronic cigarette atomizing device, which comprises an atomizing sleeve, an oil supply unit mounted in the atomizing sleeve and a heating wire unit, the atomizing sleeve has its first end configured with a nozzle cover, and its second end configured with a connecting unit, the oil supply unit comprises an oil storage cotton for storing the smoke oil and an oil guiding member for guiding the smoke oil to the heating wire unit, the heating wire unit comprises a hollow spiral tubular heating wire, a ceramic tube and an electronic wire for connecting the heating wire to the connecting unit, the oil guiding member is made of non-fiberglass fiber material, wrapped around the heating wire to have a tubular shape and fixed by a fixing wire wound around an outer wall of the oil guiding member, and wrapped around an end of the ceramic tube.

16 Claims, 4 Drawing Sheets

ELECTRONIC CIGARETTE AND ITS ATOMIZING DEVICE

CROSS REFERENCE TO RELATED APPLICATIONS

The present application is a 35 U.S.C. §371 National Phase conversion of International (PCT) Patent Application No. PCT/CN2012/084504, filed on Nov. 13, 2012, the disclosure of which is incorporated by reference herein. The PCT International Patent Application was filed in Chinese.

TECHNICAL FIELD

This invention relates to a field of electronic cigarettes, and particularly to an electronic cigarette and its atomizing device.

DESCRIPTION OF BACKGROUND

Current electronic cigarettes mainly depend on the atomizing device to be connected to the power supply apparatus, in the atomizing device the main portion is the heating device, the heating device generally consists of the heating wire, the fiberglass cord and the fiberglass tube, the heating wire is wound on the fiberglass cord and has its opposite ends connected to the electronic wires, and then the heating wire is transversely placed into the fiberglass tube, exposed ends of the electronic wires are connected with the positive and negative electrodes of the power supply apparatus, the fiberglass cord is connected with the oil storage device, and finally the smoke oil is transported to the heating wire through the fiberglass cord, and can be atomized to be fogged smoke when the heating wire is energized. Since the fiberglass cord and the fiberglass tube of the heating device are formed by numerous intertwined tiny fiberglass yarn, and they are prone to be broken, bent, and twisted. When the heating wire is wound on the fiberglass cord and fixed in the fiberglass tube, the fiberglass cord and the fiberglass tube are easy to be bent or twisted, and this process will produce countless fiberglass flocs which are adhered to the fiberglass cord and the heating wire and inner wall of the fiberglass tube, and easy to enter the mouth, respiratory tract or lung during smoking the assembled electronic cigarette, thereby causing serious harm to the human body.

SUMMARY

A technical problem can be resolved by the present invention is, to provide an electronic cigarette atomizing device, which is safe and harmless to the human body.

A further technical problem can be resolved by the present invention is, to provide an electronic cigarette, which is safe and harmless to the human body.

To resolve the above problems, the present invention provides the follow technical solution: an electronic cigarette atomizing device, comprises an atomizing sleeve, an oil supply unit mounted in the atomizing sleeve and a heating wire unit, the atomizing sleeve has its first end configured with a nozzle cover, and its second end configured with a connecting unit, the oil supply unit comprises an oil storage cotton for storing the smoke oil and an oil guiding member for guiding the smoke oil to the heating wire unit, the heating wire unit comprises a hollow spiral tubular heating wire, a ceramic tube and an electronic wire for connecting the heating wire to the connecting unit, the oil guiding member is made of non-fiberglass fiber material, the oil guiding member is wrapped around a periphery of the heating wire to have a tubular shape and fixed by a fixing wire wound around an outer wall of the oil guiding member, and also wrapped around an end of the ceramic tube.

Furthermore, the oil guiding member is made of one of the following fiber materials: cotton, chemical fiber, and a mixture of cotton and chemical fiber.

Furthermore, the oil storage cotton has a tubular shape, and is wrapped around an exterior of the oil guiding member.

Furthermore, the heating wire has its hollow chamber arranged in a same direction as a central axle of the tubular oil guiding member.

Furthermore, the fixing wire is wound around the outer wall of the oil guiding member at a location corresponding to the heating wire.

Furthermore, the connecting unit comprises a metallic threaded tube for being inserted into a second end of the atomizing sleeve and an upper electrode fixed coaxially within the metallic threaded tube by means of an insulating ring, the upper electrode is wrapped by the tubular oil guiding member, the heating wire has its one end directly connected with the upper electrode which is inserted into the tubular oil guiding member, while its another end connected with the electronic wire, and the electronic wire is extended out of the ceramic tube and connected with the metallic spiral tube at an exterior of the tubular oil guiding member.

Furthermore, the atomizing sleeve is further provided with a paster on its outer surface.

Furthermore, the fixing wire is made of any one of the following flexible wires: cotton thread, flaxen thread, yarn or chemical fiber.

On the other hand, the present invention further provides an electronic cigarette, comprising an atomizing device and a power supply device for providing power supply to the atomizing device, and the atomizing device is any one of the above-mentioned atomizing devices.

Adopting the solutions, the present invention has at least the following beneficial effects: the present invention needs no fiberglass cord any more by modifying the structure of the atomizing device, to decrease the cost, and improve production efficiency, and the most important thing is to prevent the flocs from being inhaled to do harm to the human body; while the ceramic tube instead of fiberglass tube is used as the airflow channel, to efficiently avoid inhalers to inhale fiberglass flocs which are harmful to the human body.

DETAILED DESCRIPTION OF THE EMBODIMENTS

The embodiments of the present invention are further described in detail as follows in conjunction with the accompanying drawings. It should be noted that, the embodiments and the characteristics in the embodiments can be mutually combined in case of no confliction.

Figure 1:
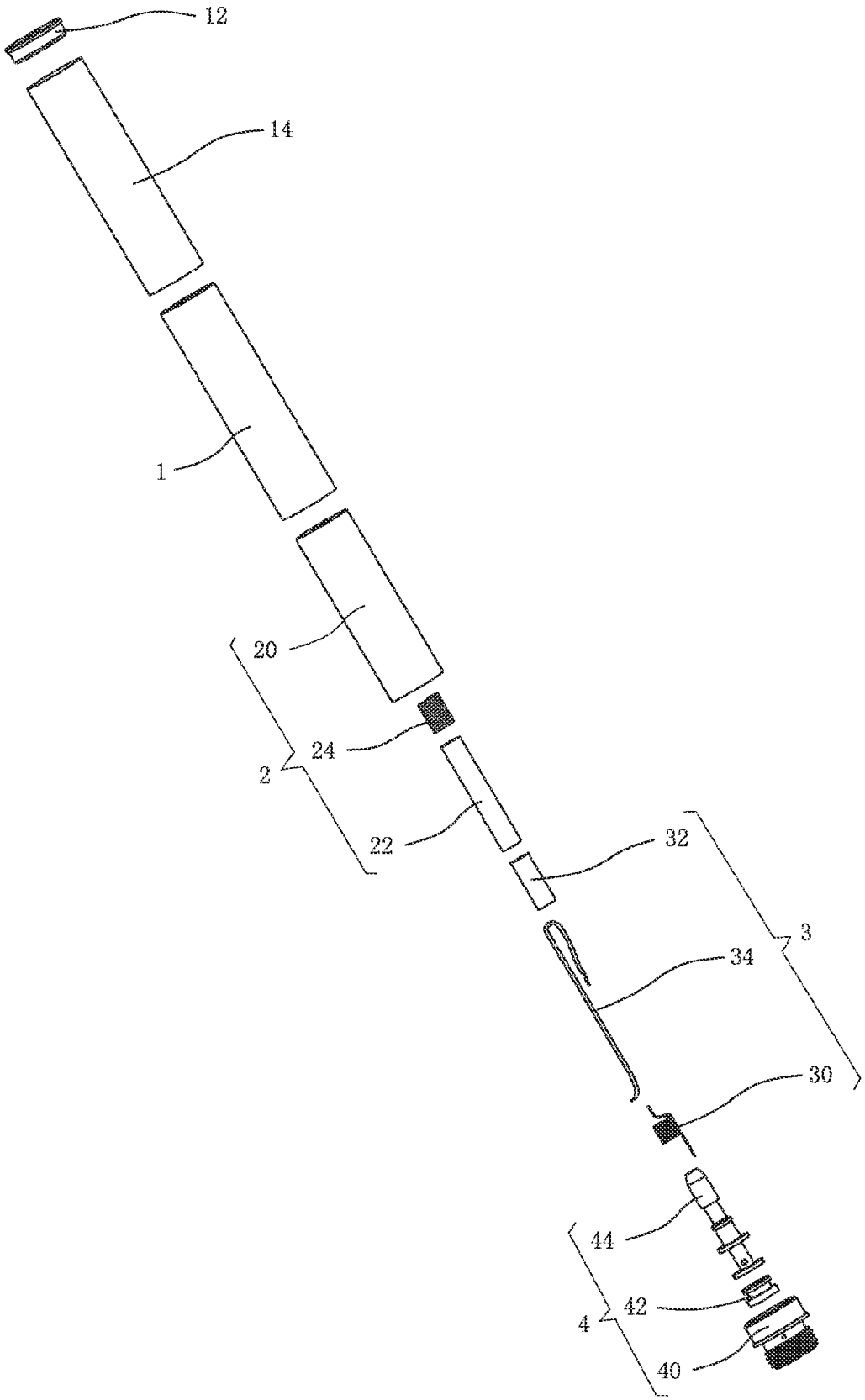
FIG. 1 is an exploded structural view of an electronic cigarette atomizing device in accordance with an embodiment of the present invention.
Figure 5:
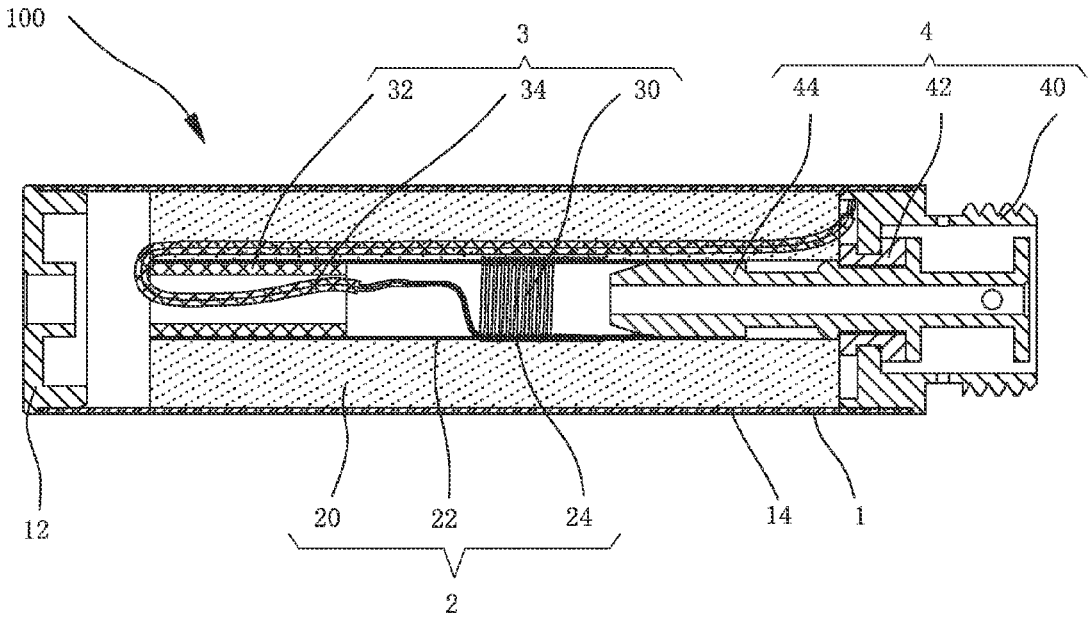
FIG. 5 is a cross-sectional view of the electronic cigarette atomizing device in accordance with the embodiment of the present invention.

As shown in FIG. 1 and FIG. 5, an embodiment of the present invention provides an electronic cigarette atomizing device 100, comprising an atomizing sleeve 1, an oil supply unit 2 mounted in the atomizing sleeve 1, a heating wire unit 3 and a connecting unit 4 mounted at one end of the atomizing sleeve.

The atomizing sleeve 1 is straight tube-shaped, and a first end thereof is configured with a nozzle cover 12. The atomizing sleeve 1 is further provided with a paster 14 on its outer surface, for aesthetic appearance.

The oil supply unit 2 comprises an oil storage cotton 20 for storing the smoke oil and an oil guiding member 22 for guiding the smoke oil to the heating wire unit 3, the oil guiding member 22 is tubular and made of non-fiberglass fiber material, for example: made of one of the following fiber materials: cotton, chemical fiber, and a mixture of cotton and chemical fiber. The oil storage cotton 20 is wrapped around an exterior of the oil guiding member 22.

The heating wire unit 3 comprises a hollow spiral tubular heating wire 30, a ceramic tube 32 and an electronic wire 34 for connecting the heating wire 30 to the connecting unit 4.

The connecting unit 4 is configured at a second end of the atomizing sleeve 1, for connecting with a power supply device of the electronic cigarette. The connecting unit 4 comprises a metallic threaded tube 40 for being inserted into a second end of the atomizing sleeve 1 and an upper electrode 44 fixed coaxially within the metallic threaded tube 40 by means of an insulating ring 42. The upper electrode 44 is wrapped by the tubular oil guiding member 22, and the heating wire 30 has its one end directly connected with the upper electrode 44 which is inserted into the tubular oil guiding member 22, while its another end connected with the electronic wire 34, the electronic wire 34 is extended out of the ceramic tube 32 and connected with the metallic spiral tube 40 at an exterior of the tubular oil guiding member 22.

Figure 2:
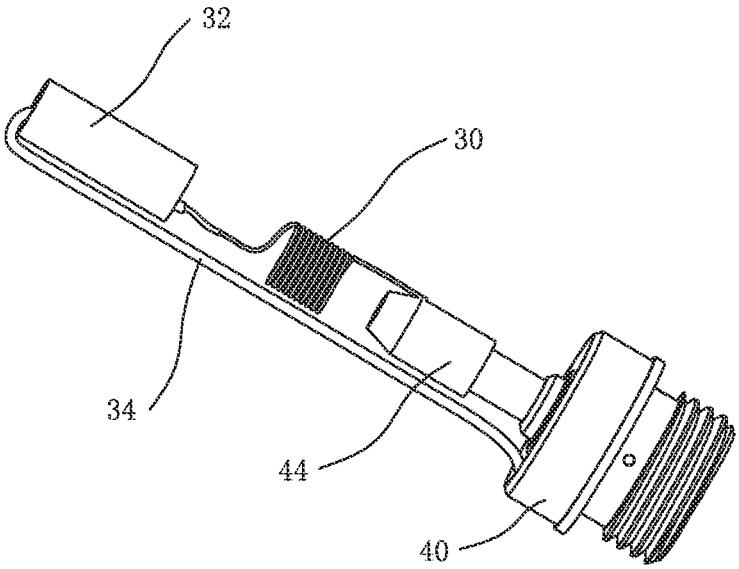
FIG. 2 is a schematic structural view of an assembly of a heating wire unit and a connecting unit of the electronic cigarette atomizing device in accordance with the embodiment of the present invention.
Figure 3:
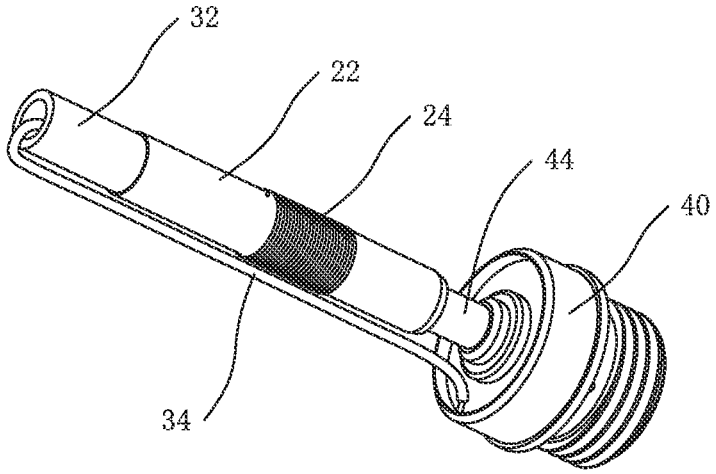
FIG. 3 is a schematic structural view of the structure as shown in FIG. 2 wrapped by an oil guiding member.
Figure 4:
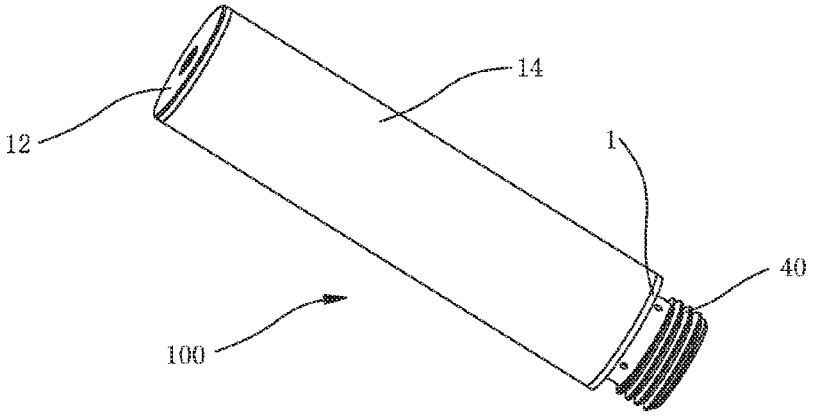
FIG. 4 is an assembled schematic structural view of the electronic cigarette atomizing device in accordance with the embodiment of the present invention.

When assembled, firstly an end of the heating wire 30 is connected with the upper electrode 44, and another end of the heating wire 30 is connected with the electronic wire 34, the electronic wire 34 is connected with the metallic spiral tube 40 after extended out of the ceramic tube 32, to achieve a semi-manufactured one as shown in FIG. 2; then the oil guiding member 22 is wound and wrapped around a periphery of the heating wire 30 and wrapped around an exterior of an end of the ceramic tube 32 and an exterior of the upper electrode 44 to have a tubular shape, the heating wire 30 has its hollow chamber arranged in a same direction as a central axle of the tubular oil guiding member 22, and is fixed by a fixing wire 24 wound around an outer wall of the oil guiding member 22, to achieve a semi-manufactured one as shown in FIG. 3, specifically, the fixing wire 24 is preferably wound around the outer wall of the oil guiding member 22 at a location corresponding to the heating wire 30 to have a sufficient contact of the oil guiding member 22 with the heating wire 30, in order to ensure the smoke oil to be smoothly transported to the heating wire 30, the fixing wire 24 mainly has the function of stably strapping the oil guiding member 22 to the heating wire 30, and can be made of various flexible wires, for example: cotton thread, flaxen thread, yarn (wool, rabbit wool) or chemical fiber and so on; the ceramic tube 32 and the connecting unit 4 are respectively assembled to opposite ends of the oil guiding member 22, wherein, the ceramic tube 32 is located at an end adjacent to the nozzle cover 12, as an airflow channel; finally, the oil guiding member 22 is further wrapped by the oil storage cotton, and sleeved with the atomizing sleeve 1, affixed with the paster 14, and installed with the nozzle cover 12, to complete the assembly of the atomizing device, and achieve the finished atomizing device 100 as shown in FIG. 4.

Figure 6:
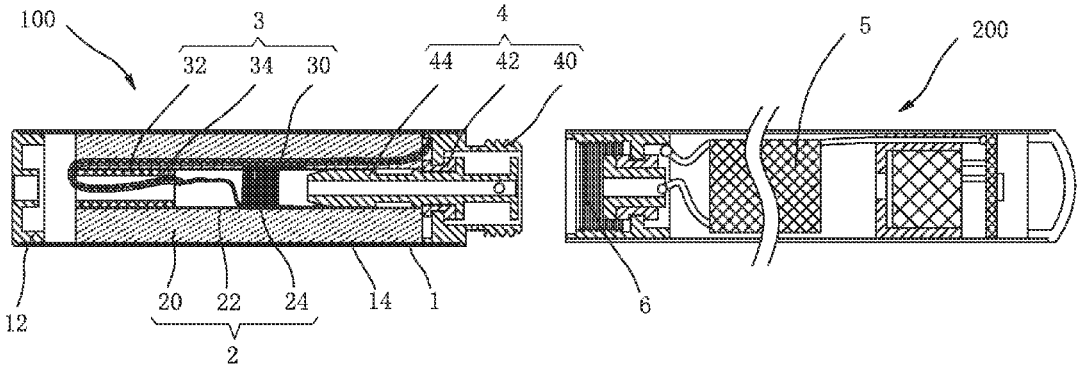
FIG. 6 is a schematic structural view of an electronic cigarette in accordance with an embodiment of the present invention.

As shown in FIG. 6, the present invention further provides an electronic cigarette, comprising the above-mentioned atomizing device 100 and the power supply device 200 for providing power supply to the atomizing device 100, wherein, the power supply device 200 is provided with a battery 5 therein, an end of the power supply device 200 which is connected with the atomizing device 100 is also correspondingly configured with a connector 6, for connecting with the connecting unit 4 of the atomizing device 100 so as to realize electrical communication, and energize the heating wire 30 of the atomizing device 100.

Though the embodiments of the present invention have been illustrated and described, for the persons of ordinary skill in this field, various changes, modifications, replacement and variations within the principle and spirit of the present invention can be made to the embodiments, the protecting scope of the present invention is defined by the appended claims and their equivalents.

What is claimed is:

1. An electronic cigarette atomizing device, comprising an atomizing sleeve, an oil supply unit mounted in the atomizing sleeve and a heating wire unit, the atomizing sleeve having its first end configured with a nozzle cover, and its second end configured with a connecting unit, the oil supply unit comprising an oil storage cotton for storing smoke oil and an oil guiding member for guiding the smoke oil to the heating wire unit, wherein, the heating wire unit comprises a hollow spiral tubular heating wire, a ceramic tube and an electronic wire for connecting the heating wire to the connecting unit, the oil guiding member is made of non-fiberglass fiber material, the oil guiding member is wrapped around a periphery of the heating wire to have a tubular shape and fixed by a fixing wire wound around an outer wall of the oil guiding member, and also wrapped around an end of the ceramic tube.

2. The electronic cigarette atomizing device as described in claim 1, wherein, the oil guiding member is made of one of the following fiber materials: cotton, chemical fiber, and a mixture of cotton and chemical fiber.

3. The electronic cigarette atomizing device as described in claim 1, wherein, the oil storage cotton has a tubular shape, and is wrapped around an exterior of the oil guiding member.

4. The electronic cigarette atomizing device as described in claim 1, wherein, the heating wire has a hollow chamber arranged in a same direction as a central axle of the tubular oil guiding member.

5. The electronic cigarette atomizing device as described in claim 1, wherein, the fixing wire is wound around the outer wall of the oil guiding member at a location corresponding to the heating wire.

6. The electronic cigarette atomizing device as described in claim 1, wherein, the connecting unit comprises a metallic threaded tube for being inserted into a second end of the atomizing sleeve and an upper electrode fixed coaxially within the metallic threaded tube by means of an insulating ring, the upper electrode is wrapped by the tubular oil guiding member, the heating wire has its one end directly connected with the upper electrode which is inserted into the tubular oil guiding member, while its another end connected with the electronic wire, and the electronic wire is extended out of the ceramic tube and connected with the metallic spiral tube at an exterior of the tubular oil guiding member.

7. The electronic cigarette atomizing device as described in claim 1, wherein, the atomizing sleeve is further provided with a paster on its outer surface.

8. The electronic cigarette atomizing device as described in claim 1, wherein, the fixing wire is made of any one of the following flexible wires: cotton thread, flaxen thread, yarn or chemical fiber.

9. An electronic cigarette, comprising an atomizing device and a power supply device for providing power supply to the atomizing device, wherein the atomizing device comprises an atomizing sleeve, an oil supply unit mounted in the atomizing sleeve and a heating wire unit, the atomizing sleeve has its first end configured with a nozzle cover, and its second end configured with a connecting unit, the oil supply unit comprises an oil storage cotton for storing smoke oil and an oil guiding member for guiding the smoke oil to the heating wire unit, the heating wire unit comprises a hollow spiral tubular heating wire, a ceramic tube and an electronic wire for connecting the heating wire to the connecting unit, the oil guiding member is made of non-fiberglass fiber material, the oil guiding member is wrapped around a periphery of the heating wire to have a tubular shape and fixed by a fixing wire wound around an outer wall of the oil guiding member, and also wrapped around an end of the ceramic tube.

10. The electronic cigarette as described in claim 9, wherein, the oil guiding member is made of one of the following fiber materials: cotton, chemical fiber, and a mixture of cotton and chemical fiber.

11. The electronic cigarette as described in claim 9, wherein, the oil storage cotton has a tubular shape, and is wrapped around an exterior of the oil guiding member.

12. The electronic cigarette as described in claim 9, wherein, the heating wire has a hollow chamber arranged in a same direction as a central axle of the tubular oil guiding member.

13. The electronic cigarette as described in claim 9, wherein, the fixing wire is wound around the outer wall of the oil guiding member at a location corresponding to the heating wire.

14. The electronic cigarette as described in claim 9, wherein, the connecting unit comprises a metallic threaded tube for being inserted into a second end of the atomizing sleeve and an upper electrode fixed coaxially within the metallic threaded tube by means of an insulating ring, the upper electrode is wrapped by the tubular oil guiding member, the heating wire has its one end directly connected with the upper electrode which is inserted into the tubular oil guiding member, while its another end connected with the electronic wire, and the electronic wire is extended out of the ceramic tube and connected with the metallic spiral tube at an exterior of the tubular oil guiding member.

15. The electronic cigarette as described in claim 9, wherein, the atomizing sleeve is further provided with a paster on its outer surface.

16. The electronic cigarette as described in claim 9, wherein, the fixing wire is made of any one of the following flexible wires: cotton thread, flaxen thread, yarn or chemical fiber.

* * * * *